United States Patent [19]

Humphrey

[11] 4,360,116

[45] Nov. 23, 1982

[54] PARTIALLY SPLIT EXTERNAL BARRIER FOR COMPOSITE STRUCTURES

[75] Inventor: William D. Humphrey, Lincoln, Nebr.

[73] Assignee: Brunswick Corporation, Skokie, Ill.

[21] Appl. No.: 214,109

[22] Filed: Dec. 8, 1980

[51] Int. Cl.[3] ..... F17C 1/06

[52] U.S. Cl. ..... 220/3; 220/414; 220/435

[58] Field of Search ..... 220/3, 414, 435, 461, 220/69; 138/30; 285/230, 235; 403/24, 25, 225, 228; 52/403, 573; 217/113

[56] References Cited

U.S. PATENT DOCUMENTS

| | | | |
|---|---|---|---|
| 2,877,801 | 3/1959 | Mercier | 138/30 |
| 3,132,761 | 5/1964 | Sylvester | 220/3 |
| 3,148,706 | 9/1964 | Mercier | 138/30 |
| 3,367,815 | 2/1968 | Ragettli et al. | 220/3 X |
| 3,843,010 | 10/1974 | Morse et al. | 220/3 |
| 3,847,716 | 11/1974 | Dorsch | 220/414 X |
| 3,860,478 | 1/1975 | Bartlow | 220/414 X |
| 3,908,851 | 9/1975 | Jacobs | 220/3 |
| 3,931,834 | 1/1976 | Caillet | 138/30 |

*Primary Examiner*—Stephen Marcus

*Attorney, Agent, or Firm*—Hosier, Niro & Daleiden, Ltd.

[57] ABSTRACT

A liquid or gaseous impervious barrier is disclosed for use in composite structures, such as pressure vessels or the like, which include a juncture at which a first filament wound laminate meets a second member, such as a second laminate or a fixed boss or fitting. The juncture is capable of separating upon flexing of the first and second laminates or members. The barrier includes a flexible member disposed between the first and second laminates at the juncture thereof, with the barrier member being sealed, as by bonding, to the first and second laminates to prevent moisture penetration about the barrier member. The barrier member is split from the exterior thereof partially therethrough to accommodate any separation at the juncture due to flexing of the first and second laminates. A folded film sheet is disposed in the split in the barrier member to prevent the split portions thereof from adhering to each other. A resilient member, such as an O-ring is disposed in the fold of the film sheet and fits into an enlarged portion formed at the base of the split in the barrier member, for holding the film sheet within the barrier member.

17 Claims, 5 Drawing Figures

10
12
14
16
18
20
22
24
26
28
30
32
36
38
40

PARTIALLY SPLIT EXTERNAL BARRIER FOR COMPOSITE STRUCTURES

BACKGROUND AND SUMMARY OF THE INVENTION

This invention relates to an external barrier means for composite structures, for instance for use in the juncture between filament wound laminates of a pressure vessel or the like.

Heretofore, barrier coats have been applied to the external surfaces of composite structures such as filament wound pressure vessels, rocket motor cases or the like, to retard moisture or other adverse environment penetration into the composite case. Extended exposures in high humidity and elevated temperature environments can considerably degrade the strength of unprotected composites.

However, existing techniques utilizing barrier coats do not provide protection at the termination of the barrier coat where the composite case is attached to fittings, such as polar bosses, or other fixed members. Other problem areas where existing techniques utilizing barrier coates are deficient include areas where laminate skirt portions of a pressure vessel join a cylindrical portion of the vessel; e.g. a juncture between first and second laminate portions comprising the skirt and cylinder of a rocket motor case.

In such instances as described above, the juncture is capable of separating due to flexing of the adjacent components, such as under pressurization of the vessel. The external barrier coats also separate at the junctures, leaving a gap which is prone to moisture penetration.

The present invention is directed to an external barrier means for composite structures such as pressure vessels, rocket motor cases, or the like, to solve the above problems relating to moisture or gaseous penetration into the composite case.

The barrier means of the present invention is disclosed herein for use in a gap between the composite and a non-yielding member, such as a polar boss, of a pressure vessel during pressurization. The invention also is shown for use at the juncture between a skirt portion and a cylinder portion of a pressure vessel, such as a rocket motor case. However, it is to be understood that the barrier means of the present invention is equally applicable for use at junctures of a wide variety of vessels or casings where the juncture is capable of separating to create a gap which is prone to moisture penetration.

In the exemplary embodiment of the invention, the barrier means includes a flexible barrier member, such as rubber or the like, disposed between first and second components of a composite structure at a juncture which is capable of separating. The barrier member is sealed, as by bonding, to the components to prevent moisture penetration around the flexible barrier member. The barrier member further is split from the exterior thereof partially therethrough to accommodate separation of the components at the juncture there between. An enlarged portion is formed at the base of the split in the barrier member to preclude any stress-riser affect at the base of the split, thereby preventing the split from increasing inwardly upon any such separation at the juncture.

Preferably, a film sheet, such as Teflon or the like, is folded onto itself and disposed in the split in the barrier member to prevent the split portions thereof from adhering to each other. The fold in the film sheet is disposed generally at the base of the split in the barrier member, and a resilient member, such as an O-ring, is disposed in the fold and sized to fit into the enlarged portion of the split in the barrier member to hold the film sheet in place.

Thus, it can be seen that a new and improved barrier means is provided for use in a juncture between yieldable components of a composite structure to retard moisture or gas penetration into the composite structure where existing techniques utilizing barrier coats are deficient.

Other objects, features and advantages of the invention will be apparent from the following detailed description taken in connection with the accompanying drawings.

DETAILED DESCRIPTION OF THE INVENTION

Figures 1, 2, 2A:
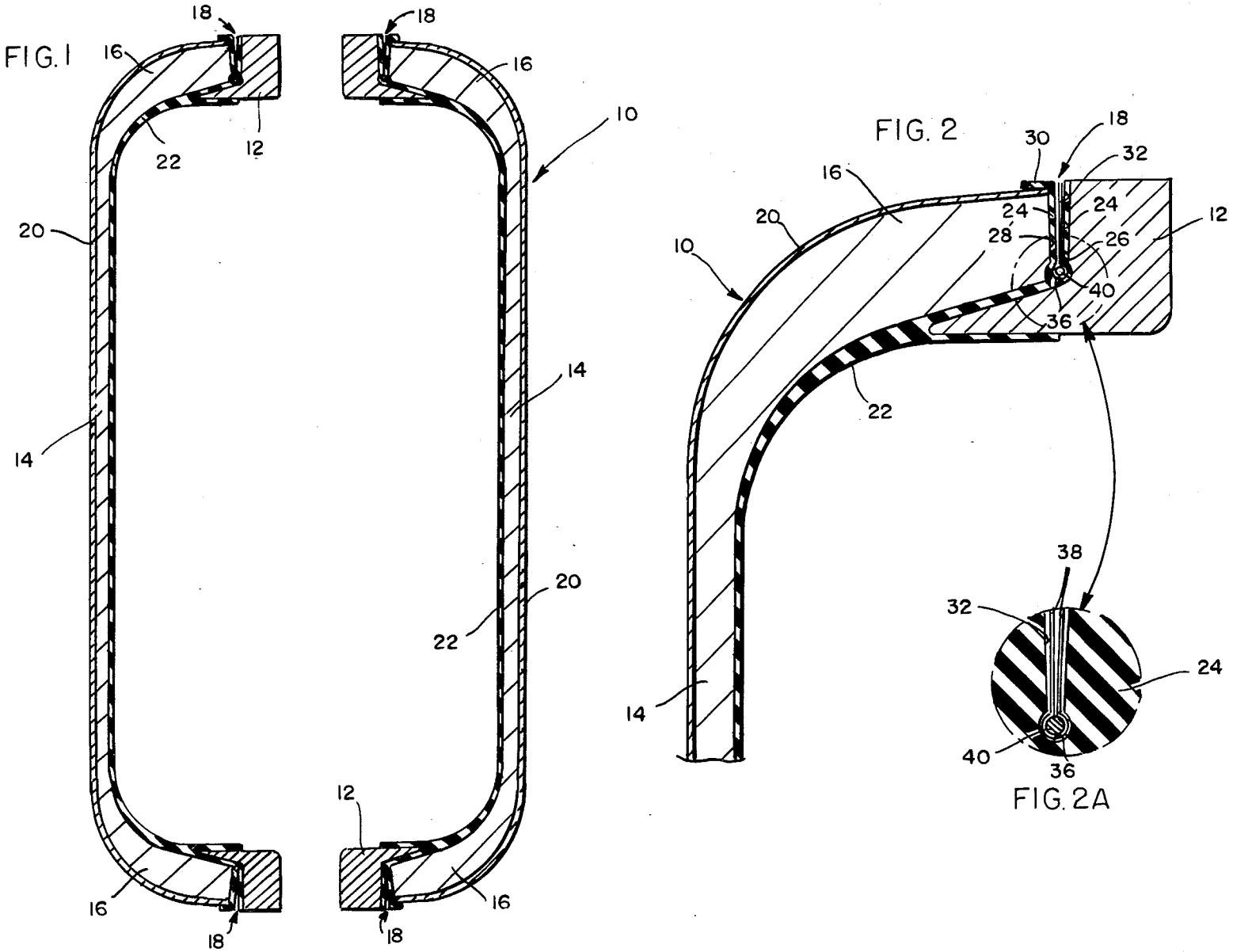
FIG. 1 is a longitudinal central sectional view through a pressure vessel having polar fittings, and incorporating the barrier means of the present invention.
FIG. 2 is a fragmented sectional view, on an enlarged scale, of the barrier means around one of the polar fittings shown in FIG. 1.
FIG. 2A is an enlargement of the base of the split in the barrier means of the present invention.

Referring to the drawings in greater detail, and first to FIG. 1, a composite structure in the form of a pressure vessel, generally designated 10, is shown and includes a pair of end fittings in the form of polar bosses 12. Pressure vessel 10 includes a filament wound composite forming a cylindrical portion 14 and a pair of dome shaped ends 16. The composite is wound about polar bosses 12, creating junctures therebetween wherein barrier means, generally designated 18, is disposed in accordance with the present invention.

An external barrier coat 20 surrounds the filament wound composite to provide protection for the filament windings thereof. The barrier coat may be of various materials, including metallic materials. The barrier coat retards moisture penetration into the composite case. In addition, the barrier coat may perform various other functions, such as protection against radiation, lightning strike, or EMI protection.

Figure 4:
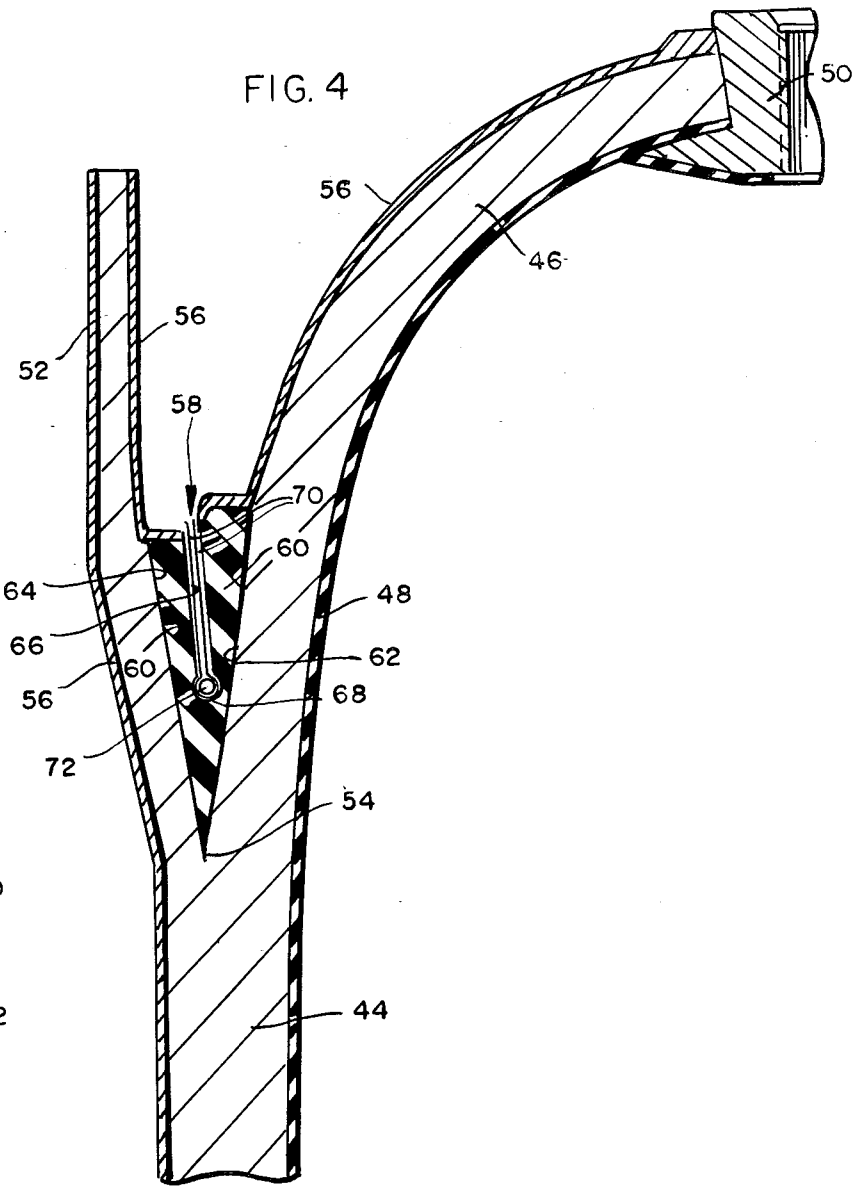
FIG. 4 is a fragmented sectional view showing the barrier means of the present invention as utilized in FIG. 3.
Figure 3:
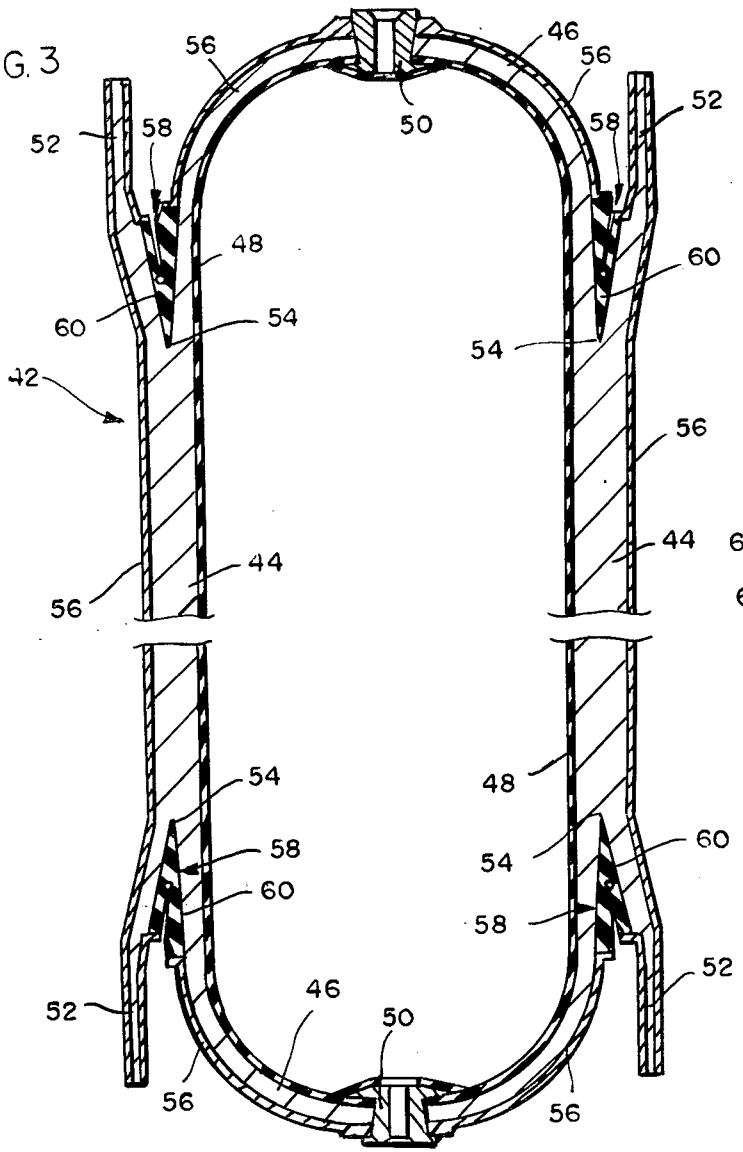
FIG. 3 is a longitudinal sectional view through a rocket motor case having junctures between skirt portions and cylindrical portions of the motor case where the barrier means of the present invention is employed.

An internal barrier member or liner 22, which is fabricated of rubber or like material, is disposed about the interior of the composite case to separate the contents of the case from the filament wound composite thereof. Barrier means 18 of the present invention is incorporated directly into portions of the internal barrier 22 which extend about and through the juncture between the dome shaped portions 16 of the composite and the polar bosses 12. However, it should be understood that this is a preferred embodiment of the invention, and separate barrier means may be employed as shown in FIGS. 3 and 4 which will be described in detail hereinafter.

With composite structures such as the pressure vessel 10 described above in relation to FIG. 1, the utilization of barrier coats, such as barrier coat 20, does not provide moisture penetration protection at the termination of the barrier coat at the juncture of the composite case with polar bosses 12. In particular, a gap will open during pressurization of the vessel between the filament wound composite and the non-yielding polar bosses which often times are fabricated of metal or like rigid material. As these gaps form during pressurization of the vessel, moisture can penetrate past barrier coat 20 at the termination of the composite around polar bosses 12. The barrier means of the present invention is designed to prevent moisture penetration in these areas.

More particularly, referring to FIG. 2, barrier means 18 of the present invention includes a flexible barrier member 24 fabricated of rubber or other resilient material. As stated above, in the embodiment of the invention shown in FIGS. 1 and 2, the flexible barrier member 24 forms a continuation of the internal barrier means or liner 22. Barrier member 24 is sealed, as by bonding, to adjacent surfaces 26 and 28 of polar boss 12 and filament wound composite 16, respectively. This prevents moisture penetration around the barrier member. In addition, the barrier member has an external flange 30 overlying barrier coat 20 and bonded thereto.

In order to accommodate any separation, as during pressurization of the vessel, between polar boss 12 and composite 16 at the juncture therebetween, barrier member 24 is split, as at 32. The split in barrier member 24 extends from the exterior of the barrier member and partially therethrough. Therefore, the barrier member sort of acts as a hinge to accommodate any separation between the polar boss and the composite case.

Referring to FIG. 2A, an enlargement of the base of split 32 in barrier member 24 is shown to illustrate particularly the base of the split. More particularly, an enlarged portion 36 is formed at the base of split 32 to preclude any stress-riser affect at the base of the barrier member to thereby prevent the split from increasing or "growing" upon any separation at the juncture between the polar boss and the composite case. This is particularly important in the event that the split becomes contaminated by environmental elements.

Means also is provided to prevent the split portions of barrier member 24 from adhering to each other, particularly when such materials as rubber are utilized. To prevent this adherence, a thin film sheet 38 of non-adhering material, such as Teflon or the like, is folded over onto itself and disposed within the split 32 in barrier member 24. This film sheet prevents the split portions of the barrier member from adhering to each other. In order to hold film sheet 38 within the split in the barrier member, a resilient O-ring 40 is disposed within the fold of the film sheet and is sized to press fit into the enlarged portion 36 at the base of split 32.

It is readily apparent that the barrier means 18 shown in conjunction with the pressure vessel 10 as described in relation to FIGS. 1–2A, provides an effective means for retarding moisture penetration into the composite case of the pressure vessel at the junctures between the composite case and polar bosses 12 or other similar fittings.

Referring to FIG. 3, a rocket motor case, generally designated 42, is shown and incorporates barrier means in accordance with the present invention. The rocket motor case includes a filament wound composite having a cylindrical portion 44 and opposite dome shaped end portions 46. An internal barrier means or liner 48 is employed similar to that described in relation to FIGS. 1 and 2. End fittings or polar bosses 50 are shown at the ends of the rocket motor case. Although not shown in the drawings, barrier means may be provided around polar bosses 50 in accordance with the present invention. Such barrier means is not shown in FIGS. 3 and 4 so as not to detract from a clear showing of the barrier means in other areas of the rocket motor case.

With rocket motor case 42 shown in FIG. 3, the cylindrical composite portion 44 is fabricated of a filament wound laminate which is joined by a pair of end skirt portions 52 comprising second laminates joining the case at junctures 54. An external barrier coating 56 surrounds the entire rocket motor case including cylindrical portion 44, domed end portions 36 and skirt portions 52. The skirt portions normally are utilized to connect one rocket motor case to another in a stage-to-stage fashion. When rocket motor case 42 is pressurized, cylindrical portion 44 tends to spread outwardly while the domed end portions 46 tend to rotate inwardly under pressure. Consequently, junctures 54 tend to separate because of this relative movement. In order to compensate for the differential movement and prevent disruption of the continuous external barrier system comprising barrier coat 56, barrier means, generally designated 58, is provided at junctures 54 in accordance with the present invention.

More particularly, and referring to FIG. 4, barrier means 58 includes a continuous, annular flexible barrier member 60 of rubber or like resilient material, disposed in junctures 54 between skirt portion 52 and cylindrical portion 44 of the composite filament wound motor case. As with barrier means 18 in FIGS. 1–2A, barrier member 60 is bonded to adjacent surfaces 62 and 64 of the motor case and of skirt portion, respectively. This seals the barrier member to prevent moisture penetration thereabout from the exterior and into the composite case. Barrier member 60 is split, as at 66, from the exterior thereof and partially therethrough to accommodate any separation at juncture 54 as described above. Thus, as with barrier member 24 in FIGS. 1–2A, barrier member 60 performs as a hinge to accommodate separation at juncture 54.

Barrier member 60 also includes an enlarged portion 68 at the base thereof to preclude any stress-riser affect at the base of split 66. This prevents the split from increasing or "growing" inwardly upon any separation at juncture 54. Barrier means 58 also includes a film sheet 70 of Teflon or like material which, like film 38 in FIG. 2A, is folded over onto itself with the fold being disposed generally at the base of split 55. A resilient O-ring member 72 is disposed within the fold of film sheet 70 and is sized to press fit within the enlarged portion 68 at the base of split 66. Thus, film sheet 70 prevents the split portions of barrier member 60 from adhering to each other, and O-ring 72 holds the film sheet in place.

Although the invention is shown herein as utilized as barrier means 18 in FIGS. 1–2A about polar bosses 12 of a pressure vessel 10, and is shown in FIGS. 3 and 4 for use at junctures 54 between a rocket motor case and laminate skirts 52, it is to be understood that the barrier means of the present invention is readily applicable for use in many other similar areas where juncture or joint separation is prevalent, for retarding moisture or gaseous penetration thereat.

It will be understood that the invention may be embodied in other specific forms without departing from the spirit or central characteristics thereof. The present examples and embodiments, therefor, are to be considered in all respects as illustrative and not restrictive, and the invention is not to be limited to the details given herein.

What is claimed is:

1. In a composite structure, such as a pressure vessel or the like, which includes a thickness of composite material terminating at a juncture with a fixed fitting or the like, and wherein said juncture is capable of separating under pressurization of said vessel, barrier means at said juncture comprising: a flexible barrier member disposed between said fixed fitting and the termination of said composite material at said juncture, said barrier member being sealed to said fixed fitting and said composite material to prevent moisture penetration around the barrier member, and said barrier member being split from the exterior thereof partially therethrough to accommodate any said separation at said juncture.

2. The barrier means of claim 1 wherein said composite material includes a barrier coat, and said split flexible barrier member extends past said barrier coat at said juncture.

3. The barrier means of claim 1, including a film in the split in said barrier member to prevent the split portions thereof from adhering to each other.

4. The barrier means of claim 3 wherein said film is in sheet form folded onto itself with the fold being disposed generally at the base of the split in said barrier member.

5. The barrier means of claim 4, including means for holding said film sheet within the split in said barrier member.

6. The barrier means of claim 5 wherein said holding means comprises an enlarged portion formed at the base of said split in said barrier member for receiving the folded end of said film sheet, and a resilient member disposed in the fold of said film sheet and sized to press fit into said enlarged portion to sandwich the film sheet therebetween.

7. The barrier means of claim 1 wherein the split in said barrier member has an enlarged portion at the base thereof to preclude any stress-riser affect at the base of the split, thereby preventing the split from increasing inwardly upon any said separation at said juncture.

8. The barrier means of claim 1 wherein said barrier member is bonded to said fixed fitting and to said composite material at said juncture to prevent moisture penetration around the barrier member.

9. In a composite structure, such as a pressure vessel or the like, which includes a juncture at which a first laminate and a second laminate meet, and wherein said juncture is capable of separating upon flexing of said first and second laminates, barrier means at said juncture comprising: a flexible barrier member disposed between said first and second laminates at said juncture, said barrier member being sealed to said first and second laminates to prevent moisture penetration about the barrier member, and said barrier member being split from the exterior thereof partially therethrough to accommodate any said separation at said juncture due to flexing of said first and second laminates.

10. The barrier means of claim 9, including a film in the split in said barrier member to prevent the split portions thereof from adhering to each other.

11. The barrier means of claim 10 wherein said film is in sheet form folded onto itself with the fold being disposed generally at the base of the split in said barrier member.

12. The barrier means of claim 11, including means for holding said film sheet within the split in said barrier member.

13. The barrier means of claim 12 wherein said holding means comprises an enlarged portion formed at the base of said split in said barrier member for receiving the folded end of said film sheet, and a resilient member disposed in the fold of said film sheet and sized to press fit into said enlarged portion to sandwich the film sheet therebetween.

14. The barrier means of claim 10 wherein the split in said barrier member has an enlarged portion at the base thereof to preclude any stress-riser affect at the base of the split, thereby preventing the split from increasing inwardly upon any said separation at said juncture.

15. The barrier means of claim 10 wherein said barrier member is bonded to said first and second laminates to prevent moisture penetration around the barrier member.

16. In a composite structure, such as a pressure vessel or the like, which includes a circular juncture at which a first member and a second filament wound member meet, and wherein said circular juncture is capable of separating upon flexing of said first and second members, barrier means at said juncture comprising: a flexible barrier member disposed between said first and second members at said circular juncture, said barrier member being sealed to said first and second members to prevent moisture penetration about the barrier member, said barrier member being split from the exterior thereof partially therethrough to accommodate any said separation at said juncture due to flexing of said first and second members, said split being provided with an enlarged portion at the base thereof, a film in the split in said barrier member to prevent the split portions thereof from adhering to each other, said film being in sheet form folded onto itself with the fold being disposed generally at the base of the split in said barrier member, and a resilient O-ring disposed within the fold in said film sheet and sized to fit into said enlarged portion of the split in said barrier member to hold said film sheet within the split in said barrier member.

17. The barrier means of claim 16 wherein said barrier member is bonded to said first and second members at said juncture to prevent moisture penetration around the barrier member.

* * * * *